US006772718B2

(12) United States Patent
Allen

(10) Patent No.: US 6,772,718 B2
(45) Date of Patent: Aug. 10, 2004

(54) HYDRAULIC VALVE SYSTEM FOR CONTROLLING FLOW OF GAS INTO OR OUT OF A VARIABLE VOLUME CHAMBER OF AN INTERNAL COMBUSTION ENGINE OR COMPRESSOR

(75) Inventor: Jeffrey Allen, Norfolk (GB)

(73) Assignee: Lotus Cars Limited (GB)

( * ) Notice: Subject to any disclaimer, the term of this patent is extended or adjusted under 35 U.S.C. 154(b) by 0 days.

(21) Appl. No.: 10/332,330

(22) PCT Filed: Jul. 6, 2001

(86) PCT No.: PCT/GB01/03027

§ 371 (c)(1),
(2), (4) Date: Jul. 23, 2003

(87) PCT Pub. No.: WO02/06641

PCT Pub. Date: Jan. 24, 2002

(65) Prior Publication Data

US 2004/0003787 A1 Jan. 8, 2004

(30) Foreign Application Priority Data

Jul. 14, 2000 (GB) ..... 0017425

(51) Int. Cl.[7] ..... F01L 9/02

(52) U.S. Cl. ..... 123/90.12; 123/90.24; 123/90.15; 251/30.02

(58) Field of Search ..... 123/90.12, 90.15, 123/90.24, 90.11, 90.62; 251/30.01, 30.02, 30.05; 417/274; 60/381, 479

(56) References Cited

U.S. PATENT DOCUMENTS

| | | | |
|---|---|---|---|
| 3,791,354 A | 2/1974 | Lorentz | 123/90.12 |
| 4,000,756 A | 1/1977 | Ule et al. | 137/596.17 |
| 4,009,695 A | 3/1977 | Ule | 123/90.13 |
| 4,200,067 A | 4/1980 | Trenne | 123/90.12 |
| 6,026,771 A | 2/2000 | Escobosa | 123/90.12 |

FOREIGN PATENT DOCUMENTS

| | | |
|---|---|---|
| EP | 0539 320 | 4/1993 |
| EP | 647770 | 4/1995 |
| JP | 60085209 | 5/1985 |
| WO | WO 92/07172 | 4/1992 |
| WO | WO 92/07174 | 4/1992 |
| WO | WO 96/22466 | 7/1996 |

*Primary Examiner*—Thomas Denion
*Assistant Examiner*—Kyle Riddle
(74) *Attorney, Agent, or Firm*—Luedeka, Neely & Graham, P.C.

(57) ABSTRACT

The present invention relates to a valve system for controlling flow of gas into or out of a variable volume chamber (8) of an internal combustion engine or a compressor. The valve system comprises a gas flow control valve (5) which opens to permit flow of gas into or out of the variable volume chamber (8); a hydraulic actuator (4) connected to the gas flow control valve (5); a pump (1) for pressurizing hydraulic fluid; a reservoir of hydraulic fluid (6); and a control system (2, 3, 21, 22, 23, 24, 25, 26, 27, 28, 29) which controls opening and closing of the gas control valve (5) by controlling flow of hydraulic fluid to the hydraulic actuator (4) from the pump (1) and flow of hydraulic fluid from hydraulic actuator (4) to the reservoir (6). The control system comprises an electrically controlled flow direction control valve (3) which controls direction of flow of hydraulic fluid to the actuator (4) to control whether the hydraulic actuator (4) opens or closes the gas flow control valve (5); and an electrically controlled switching valve (2) which controls whether or not any hydraulic fluid flows to the hydraulic actuator (4) and thereby controls the time of opening and closing of the gas flow control valve(s). The pump (1) is an electrically controlled variable flow rate pump (1) which controls the rate of opening or closing of the gas flow control valve (5) by controlling the rate of flow of hydraulic fluid to the hydraulic actuator. Operation of the pump (1), flow direction control valve (5) and the switching valve (2) is controlling by an electronic controller (21).

18 Claims, 2 Drawing Sheets

HYDRAULIC VALVE SYSTEM FOR CONTROLLING FLOW OF GAS INTO OR OUT OF A VARIABLE VOLUME CHAMBER OF AN INTERNAL COMBUSTION ENGINE OR COMPRESSOR

The present invention relates to a valve system for controlling flow of gas into or out of a variable volume chamber of an internal combustion engine or a compressor.

In a conventional four-stroke internal combustion engine a combustion chamber is provided by a variable volume chamber defined between a piston and a cylinder in which the piston reciprocates. Flow of fuel/air mixture into the chamber is controlled typically by a poppet valve which is spring-biassed into its valve seat. Typically a cam on a rotating camshaft engages a tappet which in turn engages the poppet valve and the opening and closing of the valve and the lift of the valve is controlled by the profile of the cam. The flow of combusted gases from the chamber is also typically controlled by an exhaust valve which is usually a poppet valve actuated by a cam on a rotating camshaft.

The use of rotating cams to control valve motion has limitations. First it is difficult to vary motion with e.g. engine speed and load, although this is preferable for increased engine efficiency. Also the need to keep valve train integrity limits the rate of opening and closing of the poppet valves. For this reason it has been proposed to connect hydraulic actuators to the poppet valves and use the hydraulic actuators to impart motion to the poppet valves. The hydraulic actuators then control the valve motion in response to control signals provided by an electronic control system. However, whilst such systems have been used on test bed engines cost have complexity and generally dictated against adoption of such valve systems in production engines. In particular the closed loop servo-valves typically used in such systems are quite expensive and can require a supply of pressurized fluid which can have high flow rates at high pressures.

The present invention provides in a first aspect a valve system for controlling flow of gas into or out of a variable volume chamber of an internal combustion engine or a compressor, the valve system comprising:

- a gas flow control valve which opens to permit flow of gas into or out of the variable volume chamber;
- a hydraulic actuator connected to the gas flow control valve;
- a pump for pressurizing hydraulic fluid;
- a reservoir of hydraulic fluid; and
- a control system which controls opening and closing of the gas control valve by controlling flow of hydraulic fluid to the hydraulic actuator from the pump and flow of hydraulic fluid from the hydraulic actuator to the reservoir, the control system comprising:
  - an electrically controlled flow direction control valve which controls direction of flow of hydraulic fluid to the actuator to control whether the hydraulic actuator opens or closes the gas flow control valve; and
  - an electrically controlled switching valve which controls whether or not any hydraulic fluid flows to the hydraulic actuator and thereby controls the time of opening and closing of the gas flow control valve;

and wherein:

- the pump is an electrically controlled variable flow rate pump which controls the rate of opening or closing of the gas flow control valve by controlling the rate of flow of hydraulic fluid to the hydraulic actuator; and
- operation of the pump, the flow direction control valve and the switching valve is controlled by an electronic controller.

The valve system of the present invention uses separate components to carry out individual functions of the whole system. This differs from earlier proposals to provide hydraulically actuated engine valves, when typically for each engine valve a single metering servo-valve would be used to control flow rate, direction of engine valve motion and timing of opening and closing of the engine valve. The present invention allows each component to be optimized for its unique function. The overall system may be manufactured from simpler cheaper components while achieving a cheaper system which is also more efficient than previous systems.

A preferred embodiment of the present invention will now be described with reference to the accompanying drawings in which.

Figure 1:
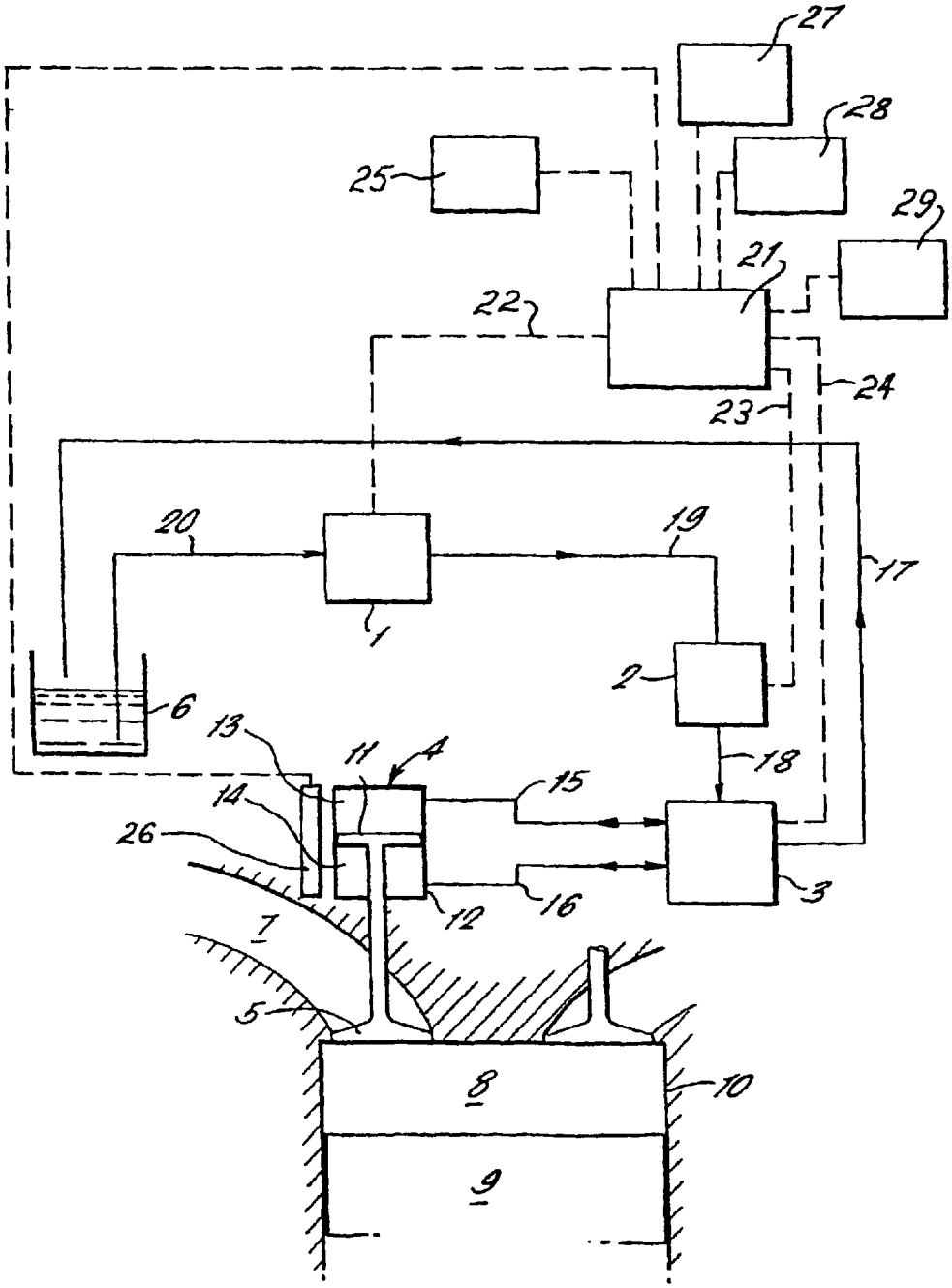
FIG. 1 is a schematic illustration of a valve system according to a first embodiment of the invention in use in an internal combustion engine.
Figure 3A:
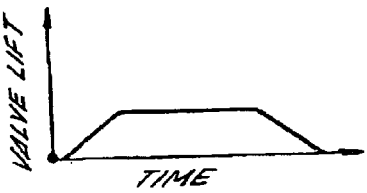
Figure 3B:
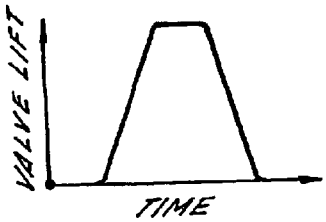
Figure 4:
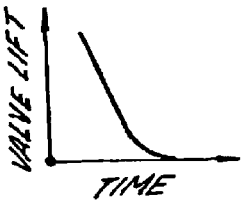

FIGS. 3*a*), *b*), *c*) and *d*) are graphical illustrations of lifts of the FIG. 1 engine valve controlled according to, respectively, second, third, fourth and fifth lift profiles; and FIG. 4 is a graphical illustration of valve motion of the engine valve of FIG. 1 as it approaches its valve seat.

Turning first to FIG. 1 it can be seen that a valve system according to the present invention comprises a poppet valve 5, a hydraulic actuator 4, an electrically controlled flow direction control valve 3, an electrically controlled switching valve 2, an electrically controlled hydraulic fluid pump 1 and a hydraulic fluid reservoir 6.

The poppet valve 5 is an inlet engine valve controlling flow of a mixture of fuel and air from an inlet passage 7 into a combustion chamber 8.

The combustion chamber 8 is a variable volume chamber defined between an engine piston 9 and an engine cylinder 10 which surrounds the engine piston 9. The engine piston 9 reciprocates in the engine cylinder 10 and the volume of the combustion chamber is thereby varied. The engine cylinder 10 is defined in the cylinder block of the engine.

A stem of the poppet valve 5 extends into the hydraulic actuator 4 and is attached to an actuator piston 11 of the hydraulic actuator 4. The actuator piston 11 is reciprocable in an actuator cylinder 12. The actuator piston 11 defines with the actuator cylinder an upper actuator chamber 13 and a lower actuator chamber 14.

The upper actuator chamber 13 is connected by a conduit 15 to the flow direction control valve 3. The lower actuator chamber 14 is connected by conduit 16 to the flow direction control valve 3. The flow direction control valve 3 is connected by a conduit 17 to the hydraulic fluid reservoir 6. The flow direction control valve 3 is connected by a conduit 18 to the switching valve 2. The flow direction control valve controls the direction of flow of hydraulic fluid to and from each of the actuator chambers 13, 14. The flow direction control valve 3 has two operating conditions, a first operating condition in which the upper actuator chamber 13 is connected to the hydraulic fluid reservoir 6 and the lower actuator chamber 14 is connected to the switching valve 2 and a second operating condition in which the lower actuator chamber 14 is connected to the hydraulic fluid reservoir 6 and the upper actuator chamber 13 is connected to the switching valve. The flow direction control valve 3 is an electrically controlled, high flow, low restriction valve, but need not have a high response rate. The flow direction valve 3 typically has a response rate of 3 to 5 milliseconds.

The electrically controlled switching valve 2 is connected by a conduit 19 to the hydraulic pump 1. The switching valve 2 is a simple on/off valve which controls timing of flow to the actuator chambers 13,14 (via the flow direction control valve 3). The switching valve 2 is an electrically controlled, high flow, low restriction valve with a rapid response. The switching valve 2 has a typical response rate of 0.1 to 0.5 milliseconds.

The hydraulic pump 1 is an electronically controlled variable pressure and variable flow pump. The pump 1 is connected by a conduit 20 to the hydraulic fluid reservoir 6 and draws fluid therefrom. The pump 1 controls the actuation rate of the actuator 4 and thereby the opening and closing rate of the inlet engine valve 5.

In operation of the valve system the pump 1 draws fluid from the reservoir 1 and then delivers pressurized fluid to the switching valve 2. When the switching valve 2 opens then the pressurized fluid flows to the flow direction control valve 3.

When the engine valve 5 is to be opened the flow direction control valve 3 is controlled to connect the upper actuator chamber 13 to the switching valve 2 and the lower actuator chamber 14 to the fluid reservoir 6. A pressure differential is established across the piston 11 which acts to force the piston 11 downwards, expelling fluid from the lower actuator chamber 14 to the reservoir 6 while fluid flows into the upper chamber 13. The pump 1 is controlled to meter the flow rate of fluid into the upper chamber 13 and thereby control the rate of lift of the engine valve 5. When the engine valve 5 has opened sufficiently the switching valve 2 will be controlled to close and to prevent further flow of fluid to the chamber 13.

When the engine valve is to be closed the flow direction control valve 3 is controlled to connect the lower actuator chamber 14 to the switching valve 2 and the upper actuator chamber 13 to the fluid reservoir 6. A pressure differential is established across the piston 11 which acts to force the piston 11 upwards, expelling fluid from the upper actuator chamber 13 to the reservoir 6 while fluid flows into the lower chamber 14. The pump 1 is controlled to meter the flow rate of fluid into the lower chamber 14 and thereby control the rate of closing of the engine valve 5. When the engine valve has closed sufficiently the switching valve 2 will be controlled to close to prevent further flow of fluid to the chamber 14.

Figure 2:
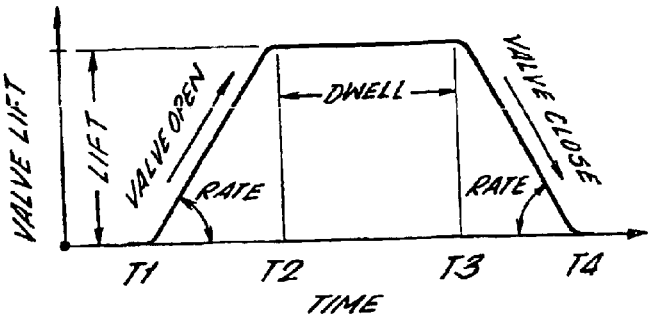
FIG. 2 is a graphical illustration of lift of the engine valve of the FIG. 1 valve system controlled according to a first lift profile.

From the above it will be understood that the rate of engine valve lift and closure is controlled by the pump 1. The total amount of engine valve lift is controlled by the duration of time that the switching valve 2 is open. The direction of valve motion is controlled by the flow direction control valve 3. This can be understood with reference to FIG. 2, which is a graphical representation of valve motion. The time T1 at which the engine valve 5 first opens is controlled by the opening of the switching valve 2. The time T2 at which the engine valve 5 stops its motion away from its valve seat (and therefore the maximum height of valve lift) is also controlled by the subsequent closing of the switching valve 2. The gradient between T1 and T2 illustrates the rate of valve lift and this gradient is controlled by the flow rate of the pump 1. Between T2 and T3 the engine valve 5 remains motionless. This is termed the dwell period. During the dwell period the switching valve 2 remains closed. The duration of the dwell period is controlled by the switching valve 2. Between T2 and T3 the flow direction valve 3 changes its operation state. Therefore, when the switching valve opens at T3 the engine valve starts to move back into engagement with its valve seat, which event occurs at T4 when the switching valve 2 closes again. The gradient between T3 and T4 and therefore the rate of closing is controlled by the flow rate of hydraulic fluid set by the pump 1.

The switching valve 2 will have ideally a needle movable into and out of a port. The needle and or the mouth of the port will preferably be profiled to give a gradual and progressive cut off to fluid flow to give a 'soft touch down' to the poppet valve, as illustrated in FIG. 4, as e.g. it approaches its valve seat.

The operation of the pump 1, switching valve 2 and flow direction control valve 3 will be controlled by electric control signals generated by the electronic controller 21 and relayed along the control lines 22, 23, 24. Typically the controller will receive signals from a sensor 25 which generates a signal indicating position of the engine piston 9 in the engine cylinder 10 (stage of engine cycle); a sensor 26 which generates a signal indicating position of the actuator piston 11 in the actuator cylinder 12; and sensors 27,28,29 which generate signals indicating engine speed and load and temperature. The electronic controller 21 will store a pre-programmed mapping table and will determine a correct engine valve position and/or motion from comparing the input signals with the mapping table.

Figure 3C:
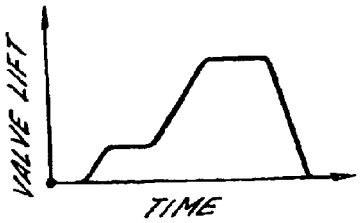
Figure 3D:
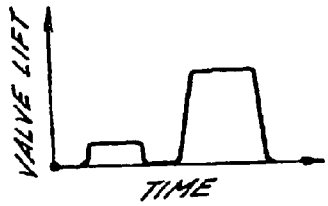

FIGS. 3*a*) to 3*d*) illustrate alternative valve lift profiles which can be provided by a single valve system according to the present invention. It would not be possible to provide a single conventional mechanical cam system capable of providing all the lift profiles shown. Indeed the lift profiles of FIGS. 3*c*) and *d*) would be difficult to provide with a conventional mechanical cam system.

The valve system of the present invention uses separate components to carry out individual functions of the whole system. This differs from earlier proposals to provide hydraulically actuated engine valves, when typically for each engine valve a single metering servo-valve would be used to control flow rate, direction of engine valve motion and timing of opening and closing of the engine valve. The present invention allows each component to be optimized for its unique function. The overall system may be manufactured from simpler cheaper components while achieving a cheaper system which is also more efficient than previous systems.

Whilst above the present invention is described with reference to its use for an inlet valve of an internal combustion engine, it is equally applicable to use for an exhaust valve and indeed all four valves of a four valve per cylinder engine would typically be controlled by the valve system. In such an arrangement a single pump would be used for all valves with a pair of valves comprises a switching valve, and a flow direction valve used for each engine valve or for each pair of engine valves. When acting to control an inlet valve the system could control flow of just air into the combustion chamber of a direct injection engine or the flow of air and fuel mixed in an indirect injection or carburetted engine.

Whilst above the present invention is described with reference to its use in an internal combustion engine, it is equally applicable to use in a compressor in which the variable volume chamber would be the compression rather than combustion chamber.

Whilst above the present invention is described as controlling motion of a poppet valve, the actuator of the invention could also be connected to other types of engine valve, e.g. slide valves and trapping valves (in a two-stroke engine).

What is claimed is:

1. A valve system for controlling flow of gas into or out of a variable volume chamber of an internal combustion engine or a compressor, the valve system comprising:

a gas flow control valve which opens to permit flow of gas into or out of the variable volume chamber;

a hydraulic actuator connected to the gas flow control valve;

a pump for pressurizing hydraulic fluid;

a reservoir of hydraulic fluid; and a control system which controls opening and closing of the gas control valve by controlling flow of hydraulic fluid to the hydraulic actuator from the pump and flow of hydraulic fluid from the hydraulic actuator to the reservoir, the control system comprising:

an electrically controlled flow direction control valve which controls direction of flow of hydraulic fluid to the actuator to control whether the hydraulic actuator opens or closes the gas flow control valve; and an electrically controlled switching valve which controls whether or not any hydraulic fluid flows to the hydraulic actuator and thereby controls the time of opening and closing of the gas flow control valve;

and wherein:

the pump is an electrically controlled variable flow rate pump which controls the rate of opening or closing of the gas flow control valve by controlling the rate of flow of hydraulic fluid to the hydraulic actuator; and operation of the pump, the flow direction control valve and the switching valve is controlled by an electronic controller.

2. A valve system as claimed in claim 1 wherein the hydraulic actuator comprises an actuator piston movable in an actuator cylinder, the actuator piston defining with the actuator cylinder a pair of variable volume actuator chambers, each of the actuator chambers being connected by an individual conduit to the flow direction control valve; and wherein the flow direction control valve has only two operating conditions:

a first operating condition in which a first of the pair of actuator chambers is connected to the pump to receive pressurized hydraulic fluid therefrom and a second of the pair of actuator chambers is connected to the fluid reservoir to expel fluid thereto; and a second operating condition in which the second of the pair of actuator chambers is connected to the pump to receive pressurized hydraulic fluid therefrom and the first of the pair of actuator chambers is connected to the fluid reservoir to expel fluid thereto.

3. A valve system as claimed in claim 1 or claim 2 wherein neither the switching valve nor the fluid direction control valve functions as a metering valve which meters flow of fluid to the hydraulic actuator to control rate of lift of the gas flow control valve.

4. A valve system as claimed in any one of the preceding claims in which the switching valve is connected between the pump and the flow direction control valve and controls flow of fluid iron the pump to the flow direction control valve.

5. A valve system as claimed in claim 1 wherein the switching valve is a high flow, low restriction valve with a response faster than the flow direction control valve.

6. A valve system as claimed in claim 1 wherein the flow direction control valve is a high flow, low restriction valve with a response slower than the response of the switching valve.

7. A valve system as claimed in claim 1 wherein the switching valve is used to control duration of a period of dwell of the gas flow control valve in the open condition thereof.

8. A valve system as claimed in claim 1 wherein the gas flow control valve is a poppet valve.

9. A valve system as claimed in claim 1 wherein the gas flow control valve is an inlet valve in an internal combustion engine which controls flow of air or fuel/air mixture into a variable volume combustion chamber.

10. A valve system as claimed in claim 1 wherein the gas flow control valve is an exhaust valve in an internal combustion engine which controls flow of combusted gases from a variable volume combustion chamber.

11. A valve system as claimed in claim 2 wherein neither the switching valve nor the fluid direction control valve functions as a metering valve which meters flow of fluid to the hydraulic actuator to control rate of lift of the gas flow control valve.

12. A valve system as claimed in claim 2 in which the switching valve is connected between the pump and the flow direction control valve and controls flow of fluid from the pump to the flow direction control valve.

13. A valve system as claimed in claim 2 wherein the switching valve is a high flow, low restriction valve with a response faster than the flow direction control valve.

14. A valve system as claimed in claim 2 wherein the flow direction control valve is a high flow, low restriction valve with a response slower than the response of the switching valve.

15. A valve system as claimed in claim 2 wherein the switching valve is used to control duration or a period of dwell of the gas flow control valve in the open condition thereof.

16. A valve system as claimed in claim 2 wherein the gas flow control valve is a poppet valve.

17. A valve system as claimed in claim 2 wherein the gas flow control valve is an inlet valve in an internal combustion engine which controls flow of air or fuel/air mixture into a variable volume combustion chamber.

18. A valve system as claimed in claim 2 wherein the gas flow control valve is an exhaust valve in an internal combustion engine which controls flow of combusted gases from a variable volume combustion chamber.

* * * * *